US006962528B2

(12) United States Patent
Yokota

(10) Patent No.: US 6,962,528 B2
(45) Date of Patent: Nov. 8, 2005

(54) GAME DEVICE

(75) Inventor: Tetsuya Yokota, Tokyo (JP)

(73) Assignee: Aruze Corporation, Tokyo (JP)

( * ) Notice: Subject to any disclaimer, the term of this patent is extended or adjusted under 35 U.S.C. 154(b) by 727 days.

(21) Appl. No.: 10/157,047

(22) Filed: May 30, 2002

(65) Prior Publication Data

US 2002/0198035 A1 Dec. 26, 2002

(30) Foreign Application Priority Data

May 30, 2001 (JP) ..... P2001-162728

(51) Int. Cl.[7] ..... A63F 9/24
(52) U.S. Cl. ..... 463/25; 463/46
(58) Field of Search ..... 463/25, 46

(56) References Cited

U.S. PATENT DOCUMENTS 3,940,136 A * 2/1976 Runte ..... 463/3
D297,655 S * 9/1988 Daugherty ..... D21/325
5,048,900 A 9/1991 Nunn
5,386,903 A * 2/1995 Rothschild et al. ..... 194/350
5,456,468 A * 10/1995 Stringfellow et al. ..... 463/46
5,813,914 A * 9/1998 McKay et al. ..... 463/46
6,146,274 A 11/2000 Salour et al.
6,201,532 B1 * 3/2001 Tode et al. ..... 345/156

* cited by examiner

*Primary Examiner*—Mark Sager
(74) *Attorney, Agent, or Firm*—Leydig, Voit & Mayer, Ltd.

(57) ABSTRACT

A game device for playing a game by inserting a game-playing medium into an insertion section includes a casing; a main door having a display section on which game elements are displayed and that can be freely opened and closed with respect to the casing; a front door releasably located below the main door and on a front face of the casing, attachment of the front door to the casing and release of the front door from the casing being locked by closing the main door and released by opening the main door.

5 Claims, 6 Drawing Sheets

GAME DEVICE

BACKGROUND OF THE INVENTION

1. Field of the Invention

The present invention relates to a game device wherein a game can be played by inserting game-playing media such as tokens.

2. Description of the Related Art

Game devices such as slot-machines whereby games can be played by insertion of game-playing media such as tokens or coins are installed in game centers or casinos. When extracting tokens etc packed therein during transportation or when recovering tokens accumulated in the accumulation box, the administrator performed such tasks by opening the front door (sometimes called the "maintenance door") provided in the front face of the casing of the device.

SUMMARY OF THE INVENTION

However, with a conventional game device, in opening such a front door, there were the following problems. Specifically, typically, the front door was fixed by a hinge to the casing and locking to effect attachment or release thereof with respect to the casing was performed using a key. However, a game device is provided with keys for various different components apart from the front door, so in order to open the front door the administrator had to search for the key for the front door from among a plurality of keys; this was a troublesome operation.

A further demand was to ensure a wide space for performing the operation of extracting tokens etc rapidly once the front door was opened.

In view of the foregoing, an object of the present invention is to provide a game device wherein a special key for the front door is unnecessary and wherein a wide working space can be guaranteed.

In order to solve the foregoing problems, according to the present invention a game device wherein a game is played by inserting a game-playing medium into an insertion section comprises: a casing; a main door having a display section on which the game is displayed and that can be freely opened and closed with respect to the casing; and a front door releasably provided below the main door and on the front face of the casing; in which attachment/release of the front door to the casing is locked by closing the main door and the locking is released by opening the main door.

In a game device according to the present invention, the main door which has a display section where the game is displayed is made free to be opened and closed with respect to the casing. Thus, by closing this main door, the front door is locked onto the casing so that it cannot be attached/released; contrariwise, by opening the main door, this locking is eliminated, so that the front door can be attached/released. That is, since the locking of the front door is released simply by opening the main door, a special key for the front door is unnecessary. Also, although the main door is opened when the front door is removed from the casing, since this main door is comparatively large, being provided with the aforementioned display section, a wide working space can be ensured.

Also, in a game device according to the present invention, the front door may be capable of engagement with the casing, a pressing section that presses the front door in a state in which the main door is closed may be provided on the main door, and it may be arranged that attachment/release of the front door to the casing can be locked by pressing on the pressing section. In this case, when mounting the front door onto the casing, the front door may be securely fixed by means of the pressing section.

Also, in a game device according to the present invention, preferably the main door is mounted so as to be freely rotatable about a prescribed axis with respect to the casing. If such a construction is adopted, the main door can be opened simply by rotating, making it possible to perform the attachment/removal operation of the front door more easily and rapidly than in the case where the main door is completely removed from the casing.

Also, in a game device according to the present invention, preferably the casing comprises a lower, first pin and a second pin positioned above this first pin, the front door comprises a first notch that is engaged by the first pin and a second notch that is engaged by the second pin, the front door being capable of rotation about the first pin in a state in which the first notch is engaged with the first pin and the second pin being provided on the locus of rotation of the second notch when the front door is rotated.

If such a construction is adopted, in order to mount the front door on the casing, the first notch of the front door is engaged with the first pin of the casing and the front door is then rotated about the first pin until the second notch is engaged with the second pin, so this task is easy.

Furthermore, in a game device according to the present invention, preferably the front door comprises a plurality of hooks engaged with receiving sections provided on the casing and a single manual operating section for releasing the hooks engaged with the receiving sections from the receiving sections, the front door being fixed with respect to the casing in a state in which the hooks are engaged with the receiving sections.

If such a construction is adopted, when the front door is mounted on the casing, the aforementioned plurality of hooks are engaged with the receiving sections of casing and the front door assumes a condition in which it is fixed with respect to the casing. Since a plurality of hooks are engaged with the receiving sections, there is a high feeling of stability of the front door. Also, the task of releasing the front door can be performed rapidly and easily, since the plurality of hooks can be released from the receiving sections simply by operation of a single manually operated section.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

The present invention may be more readily described with reference to the accompanying drawings, in which.

DESCRIPTION OF THE PREFERRED EMBODIMENTS

Preferred embodiments of a game device according to the present invention are described in detail below with reference to the appended drawings.

[First Embodiment]

Figure 1:
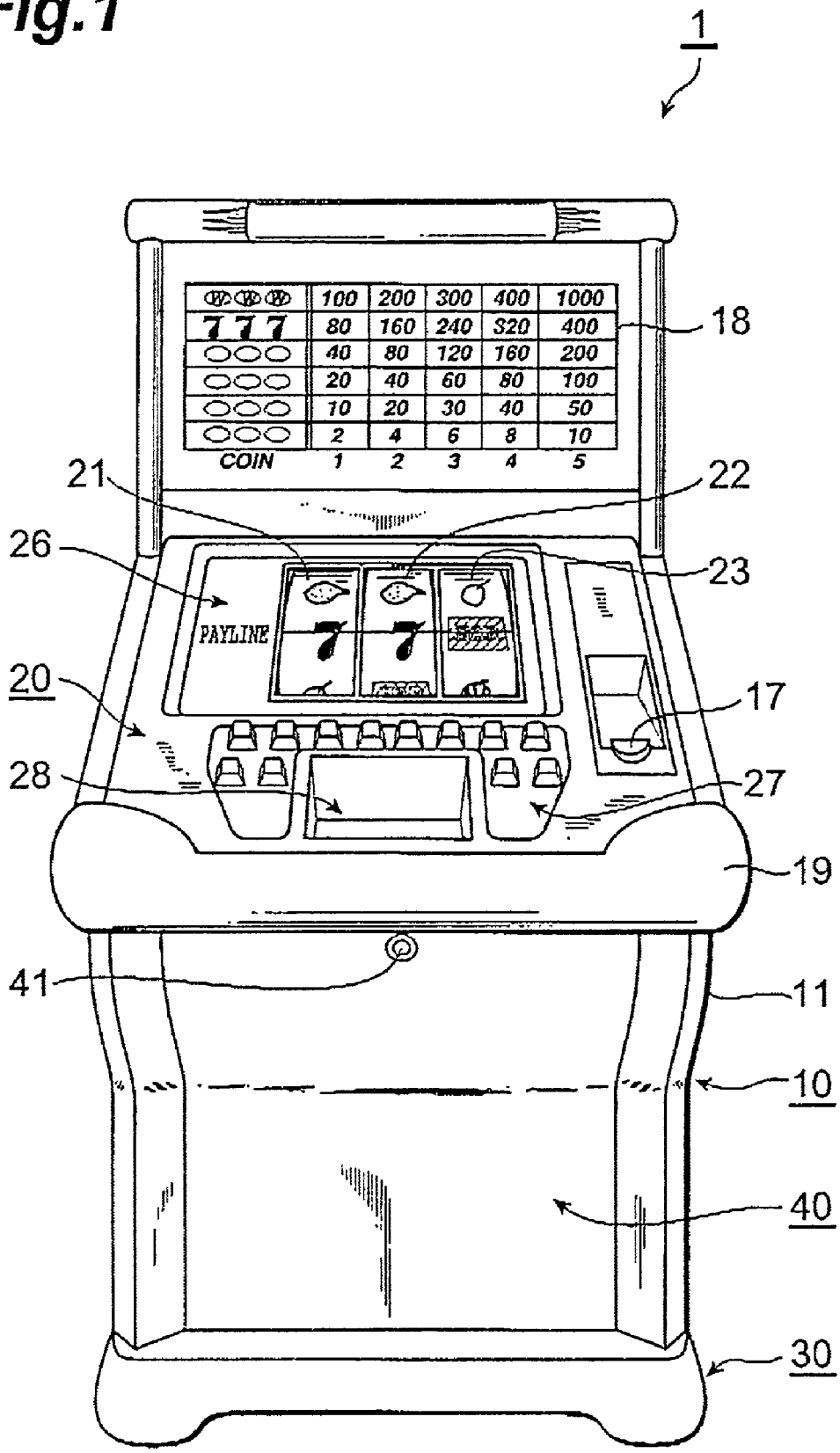
FIG. 1 is a front view illustrating a game device according to the present invention.

FIG. 1 is a front view illustrating a game device 1 according to this embodiment. Game device 1 is a so-called slot-machine, and chiefly comprises: a casing 10, a main door 20 that is free to be opened and closed with respect thereto, a foot member 30 that is releasably provided with respect to the bottom of the front face of casing 10, and a front door 40 that is releasably provided in a position below main door 20 in casing 10 and above foot member 30.

In main door 20 there is provided the equipment that is necessary for the player to play the slot-machine game; specifically, there are provided: a token insertion port (insertion section) 17 for insertion of tokens constituting game-playing media, a display section 26 on which the slot-machine game is displayed, an input section 27 on which are arranged a plurality of input buttons (start button and/or payout button) for input of instructions such as starting of the game and/or payback of tokens by a player to game device 1 and a token receiving section 28 in which paid back tokens are accumulated.

In display section 26 of main door 20 there are formed three apertures so that the player can view rotary reels 21, 22, 23 which are set in the interior of the casing from these apertures. "Display section" according to the present invention means the apertures for viewing the game displayed by devices such as the rotary reels or video display provided within the casing or a device itself that displays the game such as the rotary reels and/or display etc mounted on the main door.

When the player inserts a token into the token insertion port 17 and presses the start button, causing the rotary reels 21, 22, 23 to start to rotate and then thereafter the player presses the stop button, or on the lapse of a prescribed time, the rotary reels are stopped. The symbols "cherry" or "7" are depicted on rotary reels 21, 22, 23; if, when rotary reels 21, 22, 23 stop, the combination of symbols of the "pay line" is a winning pattern, the player can acquire tokens. A table 18 of winning patterns is displayed at the top of casing 10. The aforesaid slot-machine game is executed under the control of a control device (not shown) incorporated in the interior of casing 10.

The method of playing the slot-machine game is as described above; next, locking of attachment/release of the chief constituent members of the game device 1 will be described. Attachment/release of the constituent components is effected at the time point of the assembly operation after installation of the game device 1 in a game center and/or at the time point of the operation of extraction of the tokens packed in its interior.

Figure 2:
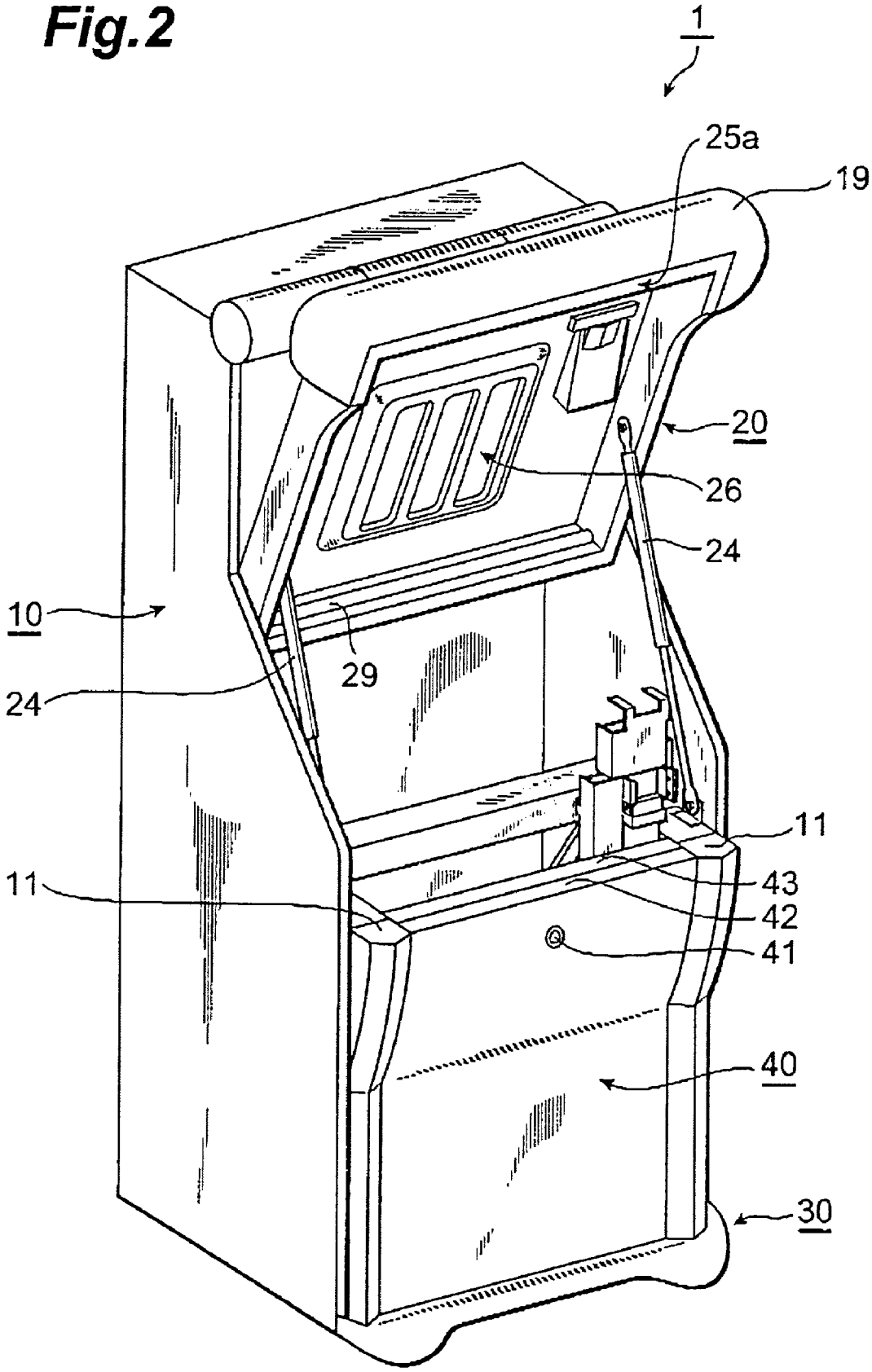
FIG. 2 is a perspective view illustrating a game device in a state in which the main door is opened.

As shown in the perspective view of FIG. 2, the main door 20 of game device 1 is mounted so as to be freely rotatable about shaft 29 with respect to casing 10. It should be noted that only portions related to the features of this embodiment are illustrated in this Figure; the rotary reels and control device etc incorporated in casing 10 are not shown.

Also, two left and right hydraulic cylinders 24, 24 link main door 20 and casing 10. In order to open main door 20, the administrator or serviceman etc (hereinbelow called "administrator etc") of the game center lifts the front elbow rest 19. Due to the extending force of hydraulic cylinders 24, 24, the administrator etc is able to open main door 20 without exerting much force. A keyhole 41 specifically for the main door is provided in the middle of the top of front door 40 in order for main door 20 to be locked so as not to open.

On the other hand, in order to close main door 20 when this is open, it suffices for the administrator to push downwards in the region of the elbow rest 19. Since the main portion of main door 20 is formed of an iron plate and so it is comparatively heavy, once the administrator has pushed main door 20 part of the way, it closes under its own weight. It could be arranged to close main door 20 by making use of the resilient force of a spring.

Figure 3:
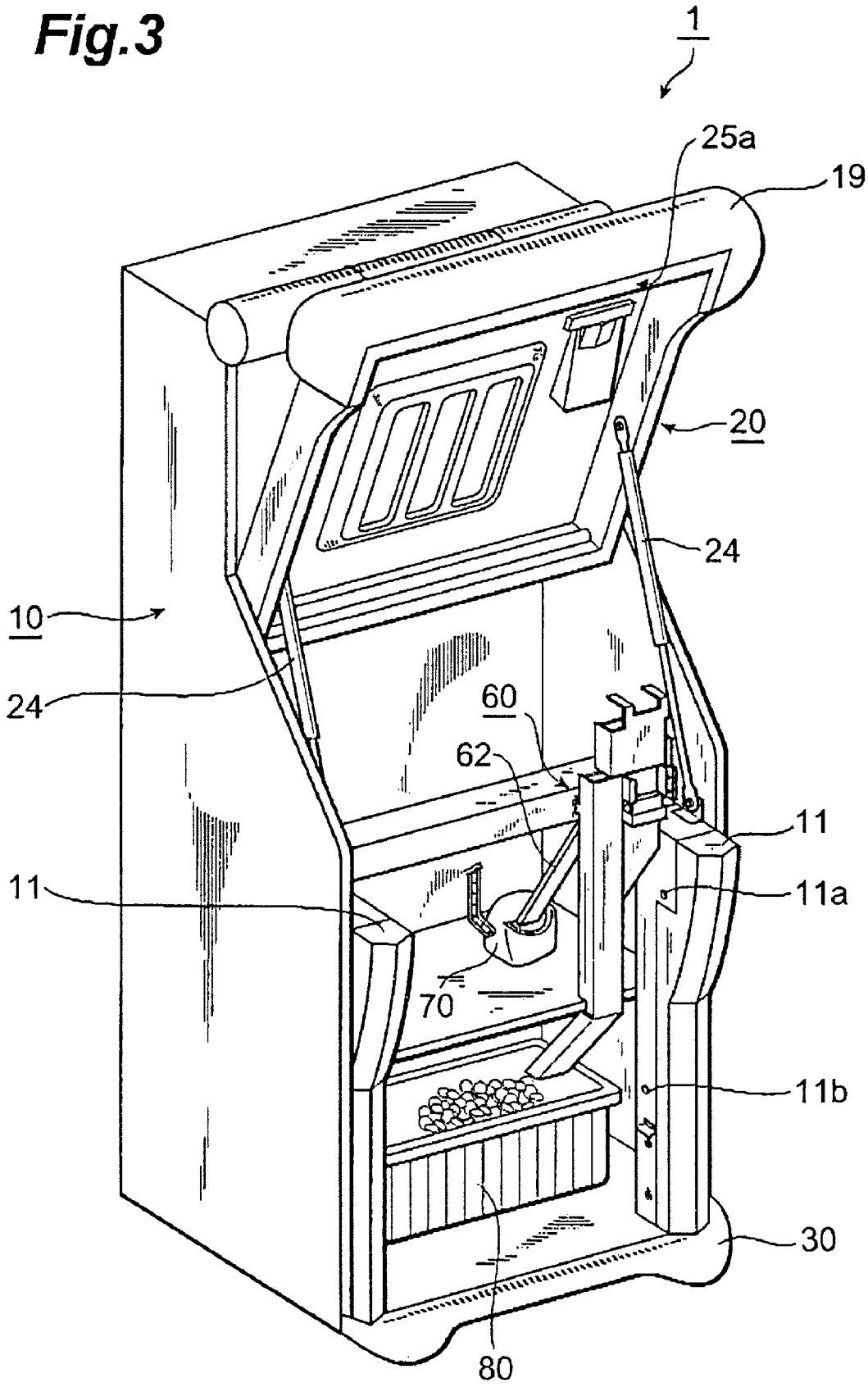
FIG. 3 is a perspective view illustrating a game device in a state in which the front door is removed.

Next, locking of attachment/release of front door 40 will be described with reference to FIG. 2 to FIG. 4. Front door 40 may also be referred to as a maintenance door and serves for the administrator to extract tokens that have accumulated in the token box 80 (see FIG. 3) in the interior or for the administrator to extract the internal mechanism and/or control device etc from casing 10 in the event of maintenance.

FIG. 2 shows the condition in which front door 40 is mounted on casing 10. FIG. 3 shows the condition in which front door 40 is removed. As shown in FIG. 3 and in FIG. 4, which is a right side view of the game device 1, support pillars 11, 11 are erected on the left and right sides of the front face of casing 10 and, at the face opposite support pillars 11, 11, there are respectively mounted a first pin 11*b* for supporting the front door and a second pin 11*a* positioned above this first pin 11*b*.

Figure 4:
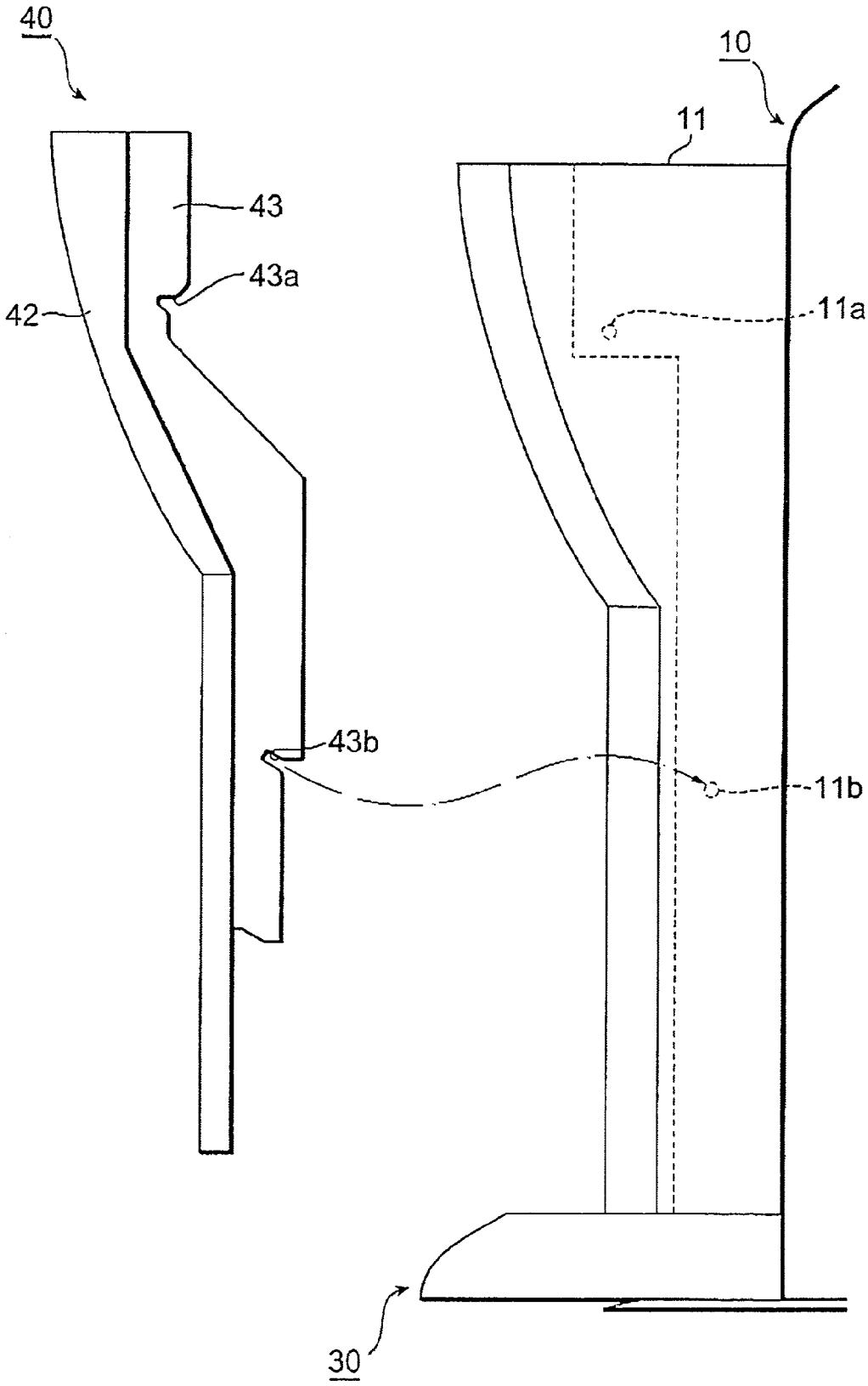
FIG. 4 is a right side view of a game device used to illustrate a condition in which the front door is mounted.

Also, as shown in FIG. 4, front door 40 is provided with a front plate 42 formed of ABS resin (acrylonitrile-butadiene-styrene resin) at the front (left-hand side in FIG. 4) and at its rear (right hand side in FIG. 4) is provided with a fixing section 43 made of steel mounted on the front plate 42. A first notch 43*b* and a second notch 43*a* are formed above and below, facing slantingly upwards, from the rear to the front (from the right-hand side to the left-hand side in FIG. 4) on fixing section 43, so that positional location of front door 40 with respect to casing 10 is effected by respective engagement of notches 43*a*, 43*b* with pins 11*a*, 11*b* of the two support pillars 11. Furthermore, in the condition in which first pin 11*b* is engaged with first notch 43*b*, front door 40 can be rotated about first pin 11*b* and second pin 11*a* is positioned on the locus of rotation of second notch 43*a* when front door 40 is rotated.

Figure 5:
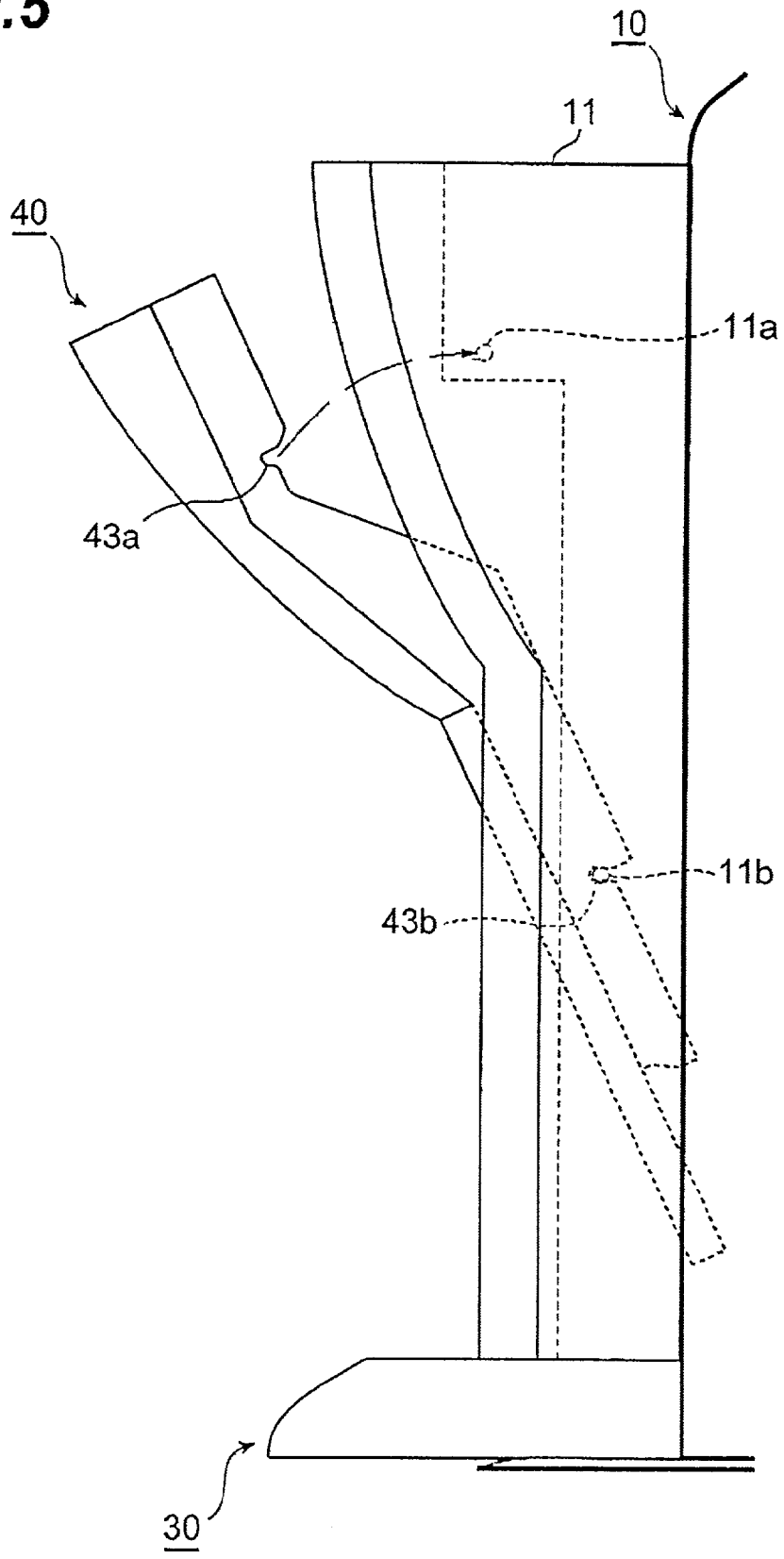
FIG. 5 is a view illustrating a condition in which a first notch of the front door is engaged with a first pin of the casing.

The step of mounting front door 40 onto the casing will now be described with reference to FIG. 4 and FIG. 5. First of all, let it be assumed that the lower i.e. the first notch 43*b* of front door 40 is engaged with first pin 11*b* of casing 10 to produce the condition shown in FIG. 5. Next, front door 40 is rotated towards casing 10 about first pin 11*b* as axis. When this is done, the second notch 43*a* of front door 40 comes into engagement with the second pin 11*a* of casing 10, so that front door 40 is mounted onto casing 10. Thus, in this embodiment, the mounting operation is facilitated since mounting onto casing 10 can be achieved simply by rotating front door 40.

When the administrator closes main door 20 in the condition in which front door 40 is fixed to casing 10, a pressing section 25*a* at the front bottom end of main door 20

(see FIG. 2) abuts the top face of front door 40 and the top face of support pillars 11, 11. Pressing section 25*a* then presses front door 40 downwards, thanks to the weight of main door 20, with the result that the attachment/release of front door 40 with respect to the casing is locked. Since notches 43*a*, 43*b* that are engaged with the pins 11*a*, 11*b* of support pillars 11 as described above are formed slantingly upwards towards the front as shown in FIG. 4, so long as main door 20 is closed, front door 40 cannot be removed from casing 10. Also, if required, it can be arranged to make it impossible to open main door 20 by using a key to effect locking at keyhole 41 provided in front door 40. Locking is arranged to be effected by engagement of a hook provided on front door 40 with main door 20, though the details relating to this special key for the main door are omitted.

By opening main door 20 by lifting it, the administrator can release the engaged condition of pins 11*a*, 11*b* of casing 10 with notches 43*a*, 43*b* of front door 40 and the locking of attachment/release of front door 40 with respect to casing 10 is thereby released.

As described above, with the game device of this embodiment, since the locking of attachment/release of front door 40 with respect to casing 10 can be turned on and off by the action of opening and closing main door 20, a special key for front door 40 is not required. Also, although it is a pre-supposition that main door 20 is opened when removing front door 40 from casing 10, since this main door 20 is comparatively large, being provided with the aforementioned display section 26 where the slot-machine game is displayed, a wide space for performing tasks such as recovery of tokens by the administrator can be ensured.

Also, in this embodiment, since main door 20 is freely rotatably mounted about shaft 29 with respect to casing 10, the task of attaching/releasing front door 40 can be performed more easily and rapidly than if main door 20 were to be completely removed from casing 10.

[Second Embodiment]

Next, a second embodiment of the present invention will be described with reference to FIG. 6. The chief difference from the first embodiment lies in that a mounting mechanism 50 for fixing to casing 10 is provided on front door 40.

Figure 6:
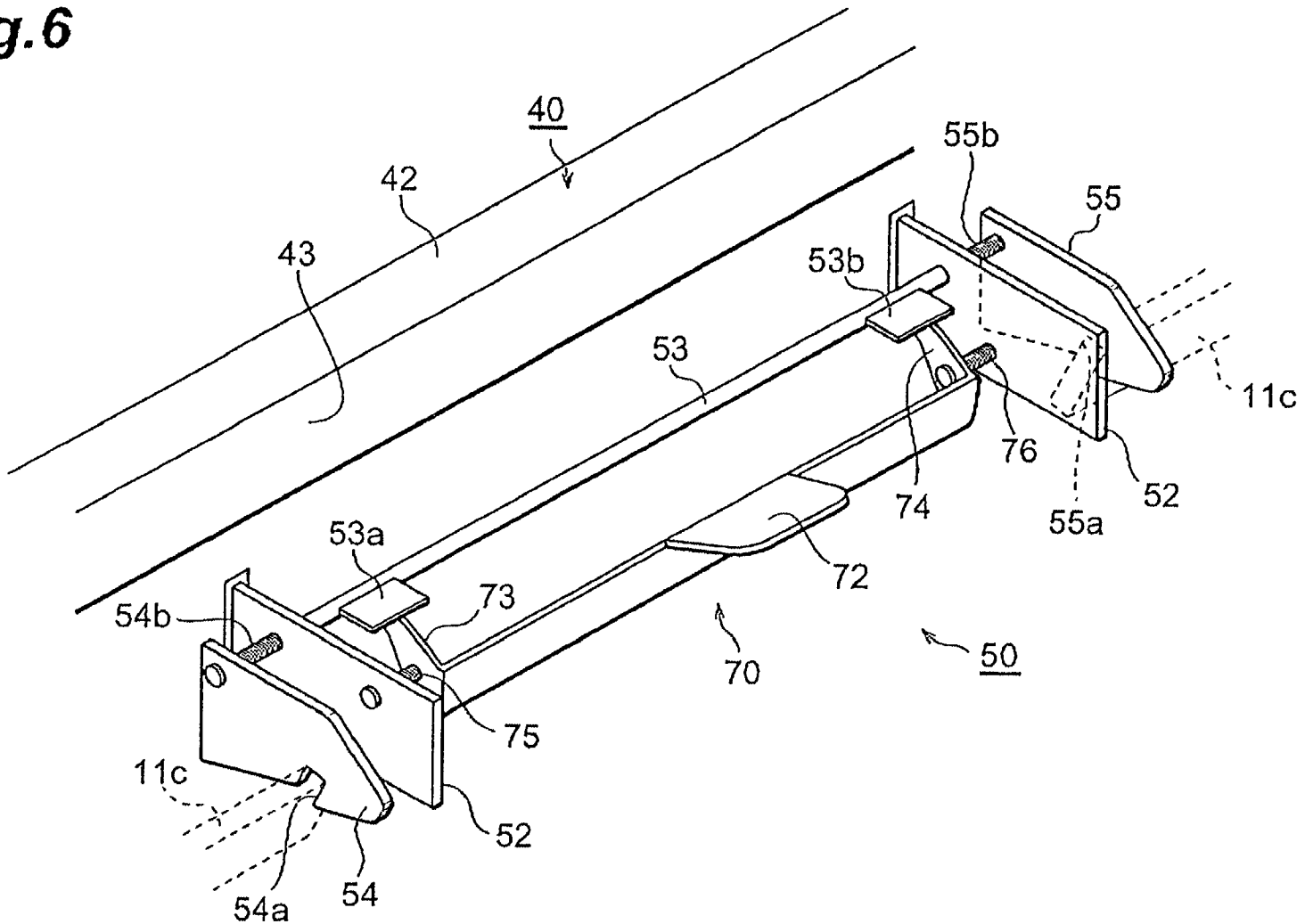
FIG. 6 is a perspective view illustrating a mounting mechanism provided on the rear side of the front door.

FIG. 6 is a perspective view illustrating the vicinity of the top of the rear face of front door 40. As shown in this Figure, mounting mechanism 50 is provided on the rear face of front door 40 and comprises two support plates 52, 52 fixed with respect to engagement section 43, a support pillar 53 that is freely rotatably passed through holes of support plates 52, 52, two hooks 54, 55 fixed at both ends of support pillar 53, and a manual operating section 70 freely rotatably mounted with respect to support plates 52, 52.

Recesses 54*a*, 55*a* are respectively formed on hooks 54, 55 and these recesses 54*a*, 55*a* engage with receiving sections 11*c*, 11*c* provided on main pillars 11.

Also, hooks 54, 55 are biased in the direction with their tips facing downwards (clockwise direction seen from the right-hand side face of casing 10) by means of screw springs 54*b*, 55*b* provided between support plates 52, 52. Two thin plates 53*a*, 53*b* are provided on support pillar 53 that supports hooks 54, 55.

Manual operating section 70 is a section operated by the administrator to remove hooks 54, 55 from receiving sections 11*c*, 11*c*; a manual operation plate 72 for pressing down the manual operating section 70 by the administrator etc is formed in the middle thereof, while pushing-up arms 73, 74 for pushing up the thin plates 53*a*, 53*b* of support pillar 53 are formed at both ends thereof. Also, the manual operating plate 72 of manual operating section 70 is biased in the upwards direction (anti-clockwise direction seen from the right hand face of casing 10) by screw springs 75, 76 provided between support plates 52, 52.

Thanks to this construction, as in the first embodiment, when first notch 43*b* and second notch 43*a* are respectively engaged with first pin 11*b* and second pin 11*a*, receiving sections 11*c*, 11*c* of casing 10 engage with recesses 54*a*, 55*a* of hooks 54 and 55 so that front door 40 is fixed with respect to casing 10. A high feeling of stability of front door 40 is obtained since, in this process, a plurality of hooks 54, 55 are engaged with receiving sections 11*c*, 11*c* of casing 10. Attachment/release of front door 40 with respect to casing 10 is then locked in the same way as in the case of the first embodiment by closing main door 20.

Then, in order to remove front door 40 from casing 10, first of all, the locking is released by opening main door 20. Next, the administrator presses the manual operating plate 72 downwards. When this is done, operating section 70 is rotated, causing thin sheets 53*a*, 53*b* of support pillar 53 to be pressed upwards by the pressing-up arms 73, 74 at both ends. When thin sheets 53*a*, 53*b* are pressed upwards, both hook 54 and hook 55 are simultaneously rotated with the rotation of support pillar 53, and are thereby released from receiving sections 11*c*, 11*c*. Front door 40 can thereby be removed from casing 10. Thus, in this embodiment, since a plurality of hooks 54, 55 can be released from receiving sections 11*c*, 11*c* simply by manual operation of a single manual operating section 70, the task of removal of front door 40 can be performed rapidly and easily.

While a specific description of the invention made by the present inventors has been given above with reference to embodiments, the present invention is not restricted to these embodiments. For example, the game device is not restricted to a slot-machine but could be a video game, poker game or prize game etc. Also, the game-playing media employed in the game device are not restricted to tokens and coins could be used.

Furthermore, the number of hooks described in the second embodiment is not restricted to two but could be three or more. Also, a construction could be adopted wherein the hooks are released from the receiving sections by pulling the manual operating plate of the operating section up in the upwards direction rather than by pushing it downwards.

As described above, with a game device according to the present invention, by closing the main door, which is provided with the display section whereby the game is displayed, the front door is locked onto the casing so that it cannot be attached/released and contrariwise, by opening the main door, this locking is released, making it possible to attach/remove the front door. That is, since the locking of the front door is released simply by opening the main door, a special key for the front door becomes unnecessary. Also, although it is a pre-supposition that when removing the front door from the casing the main door is opened, since this main door is comparatively large, being provided with a display section as described above, a wide working space can be guaranteed.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A game device for playing a game by inserting a game-playing medium into an insertion section, comprising:

a casing;

a main door having a display section on which game elements are displayed and that can be freely opened and closed with respect to said casing; and a front door releasably located below said main door and on a front face of said casing, wherein attachment of said front door to and release of said front door from said casing is locked by closing said main door, and unlocked by opening said main door.

2. The game device according to claim 1, wherein said front door can be fixed in place by engagement with said casing, including a pressing section on said front door and that presses said front door when said main door is closed, and wherein attachment of said front door to and release of said front door from said casing is locked by said pressing section.

3. The game device according to claim 1, wherein said main door is freely rotatable about an axis with respect to said casing.

4. The game device according to claim 1, wherein said casing comprises a lower first pin and a second pin positioned above said first pin; and said front door comprises a first notch engaged by said first pin and a second notch engaged by said second pin, said front door being rotatable about said first pin when said first notch is engaged with said first pin, and said second pin being located on a locus of rotation of said second notch when said front door is rotated.

5. The game device according to claim 1, wherein said casing comprises receiving sections, and said front door comprises a plurality of hooks engaging said receiving sections, and further including a single manual operating section for releasing said hooks from engagement with said receiving sections, said front door being fixed in position with respect to said casing when said hooks are engaged with said receiving sections.

* * * * *